US007043187B2

(12) United States Patent
Brown et al.

(10) Patent No.: US 7,043,187 B2
(45) Date of Patent: May 9, 2006

(54) CONDUCTIVE FIBER BRUSH CLEANER HAVING BRUSH SPEED CONTROL

(75) Inventors: Kenneth J. Brown, Rochester, NY (US); Joseph A. Kwiatkowski, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 970 days.

(21) Appl. No.: 10/079,987

(22) Filed: Feb. 21, 2002

(65) Prior Publication Data

US 2003/0043419 A1 Mar. 6, 2003

Related U.S. Application Data

(60) Provisional application No. 60/317,395, filed on Sep. 5, 2001.

(51) Int. Cl.
*G03G 21/00* (2006.01)

(52) U.S. Cl. ..... 399/343; 399/353; 399/354

(58) Field of Classification Search ..... 399/343, 399/344, 345, 353, 354, 34, 71; 15/256.5
See application file for complete search history.

(56) References Cited

U.S. PATENT DOCUMENTS 6,539,197 B1 * 3/2003 Waterschoot ..... 399/353
6,594,457 B1 * 7/2003 Tsutsumi et al. ..... 399/101
6,678,483 B1 * 1/2004 Brown et al. ..... 399/34

FOREIGN PATENT DOCUMENTS

JP 11-212417 * 8/1999

* cited by examiner

*Primary Examiner*—Hoan Tran

(57) ABSTRACT

A method and structure for an image processing apparatus that includes an image bearing surface adapted to receive electrostatically charged toner, a cleaning brush adapted to remove waste particles from the image bearing surface, a detone roller adapted to remove the waste particles from the cleaning brush, and a speed controller adapted to maintain a rotational speed of the cleaning brush above a minimum speed below which the waste particles would not be removed from the image bearing surface and below a maximum speed above which the waste particles would be thrown from the cleaning brush.

27 Claims, 4 Drawing Sheets

CONDUCTIVE FIBER BRUSH CLEANER HAVING BRUSH SPEED CONTROL

This application claims the benefit of Provisional Application No. 60/317,395 filed Sep. 5, 2001.

BACKGROUND OF THE INVENTION

1. Field of the Invention

The present invention relates in general to a cleaning assembly for an electrostatographic marking engine, and more particularly to a cleaning assembly which has a unique control for the operating speed of the conductive fiber brush that reduces the contamination of the image processing apparatus.

2. Description of the Related Art

In a typical commercial reproduction apparatus (electrostatographic copier/duplicators, printers, or the like), a latent image charge pattern is formed on a uniformly charged dielectric member. Pigmented marking particles are attracted to the latent image charge pattern to develop such images on the dielectric member. A receiver member is then brought into contact with the dielectric member. An electric field, such as provided by a corona charger or an electrically biased roller, is applied to transfer the marking particle developed image to the receiver member from the dielectric member. After transfer, the receiver member bearing the transferred image is separated from the dielectric member and transported away from the dielectric member to a fuser apparatus at a downstream location. There, the image is fixed to the receiver member by heat and/or pressure from the fuser apparatus to form a permanent reproduction thereon.

However, not all of the marking particles are transferred to the printing material and some remain upon the belts or drum. Therefore, a cleaning assembly is commonly used to remove the excess marking particles. The cleaning assembly usually includes an electrostatic cleaning brush (detone roller), a skive, and a receptacle to hold the excess marking particles (waste toner material). The devices within the cleaner assembly generally rotate to remove waste particles.

A problem occurs when toner on the conductive fiber brush becomes airborne because it is possible for such airborne waste toner particles to be carried outside the cleaner casing through the viscous boundary layer of air created due to the rotation of the cleaning brush. If this waste toner exits the cleaning assembly, it can contaminate the remaining portions of the image processing apparatus. Therefore, there is a need to prevent waste toner particles that are on the conductive fiber brush from becoming airborne and exiting the cleaner assembly. The invention discussed below addresses this problem by controlling the speed of the brush to prevent waste toner particles from being thrown from the conductive fiber brush.

SUMMARY OF THE INVENTION

In view of the foregoing and other problems, disadvantages, and drawbacks of the conventional cleaner assembly, the present invention has been devised, and it is an object of the present invention to provide a structure and method for an improved cleaner assembly.

In order to attain the object suggested above, there is provided, according to one aspect of the invention an image processing apparatus that includes an image bearing surface adapted to receive electrostatically charged toner, a cleaning brush adapted to remove waste particles from the image bearing surface, a detone roller adapted to remove the waste particles from the cleaning brush, and a speed controller adapted to maintain a rotational speed of the cleaning brush above a minimum speed below which the waste particles would not be removed from the image bearing surface and below a maximum speed above which the waste particles would be thrown from the cleaning brush.

The image bearing surface could be a charged photoconductive drum or belt and is held at a predetermined potential. The invention also includes an intermediate transfer member adapted to receive the electrostatically charged toner from the image bearing surface by contacting the image bearing surface. The invention can also include a second detone roller, a second cleaning brush, and a second speed controller for the intermediate transfer member.

The invention solves the problem of particles being lost from the brush by locating an intermediate speed at which the tips of a cleaning brush should travel in order to be fast enough to allow the brush to effectively remove particles from the substrate being cleaned, yet not so fast as to cause the particles to be thrown from the brush because of excessive centripetal forces. An important feature of the invention is that the invention does not simply arbitrarily slow the brush to prevent particles from being expelled therefrom. To the contrary, the invention defines an optimal speed at which the maximum number of particles are picked up by the brush and maintained by the brush (until they are transferred to the detone roller).

BRIEF DESCRIPTION OF THE DRAWINGS

The foregoing and other objects, aspects and advantages will be better understood from the following detailed description of the preferred embodiments of the invention with reference to the drawings, in which.

DETAILED DESCRIPTION OF PREFERRED EMBODIMENTS OF THE INVENTION

Figure 1A:
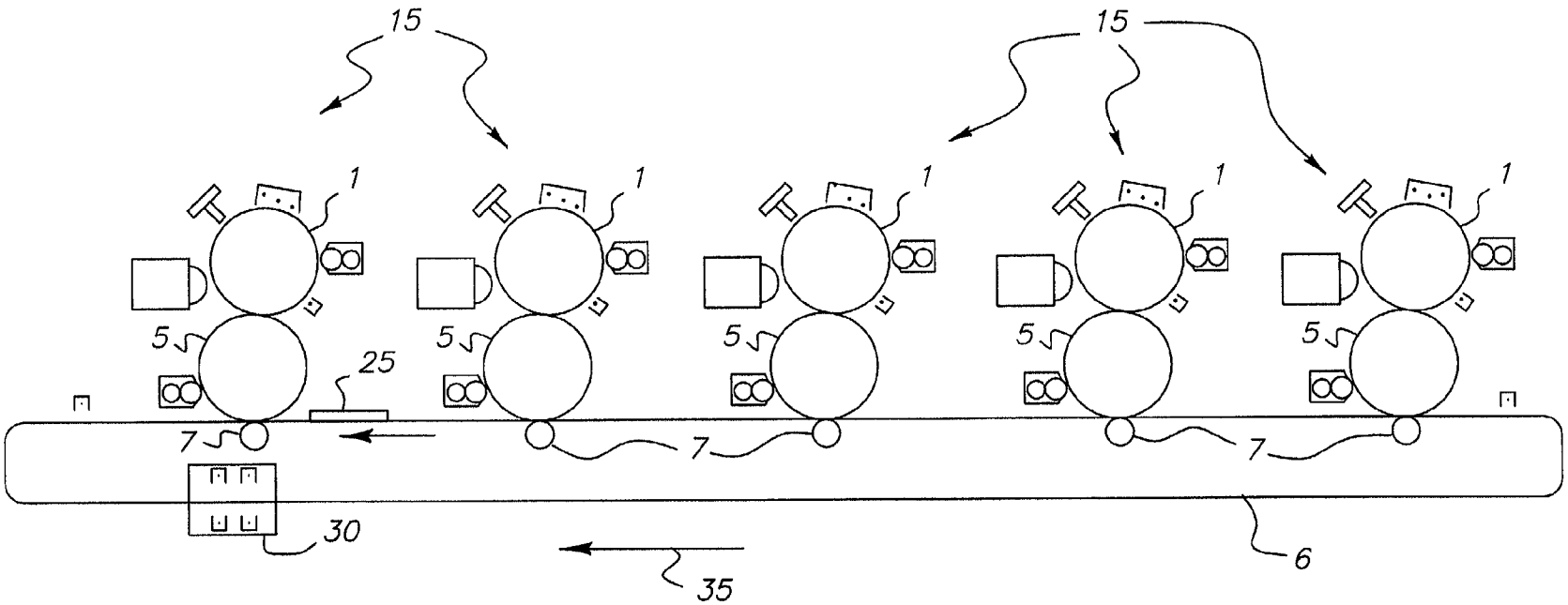
FIGS. 1A and 1B are side elevation schematic views of a color printer apparatus utilizing a cleaning apparatus of the invention.

FIG. 1A illustrates an apparatus in which the invention may be used. A conveyor 6 is drivable to move a receiving sheet 25 (e.g., paper, plastic, etc.) past a series of stations 15. One of the stations 15 is shown in greater detail in FIG. 1B.

With the invention, a primary image member (for example a photoconductive drum) 1 within each imaging station 15 is initially charged by a primary charging station 2. This charge is then modified by a printhead 3 (e.g., LED printhead) to create an electrostatic image on the primary image member 1. A development station 4 deposits toner on the primary image member 1 to form a toner image corresponding to the color of toner in each individual imaging station 15. The toner image is electrostatically transferred from the primary image member 1 to an intermediate transfer member, for example, intermediate transfer roller or drum 5. While both of the primary image member 2 and the intermediate transfer drum 5 are shown as drums, as would be known by one ordinarily skilled in the art, these could also comprises belts or similar image transfer surfaces. The primary image member 2 and the intermediate transfer drum 5 are used in these examples to simplify the explanation of the invention; however, the invention is not limited to drums, but instead, is applicable to all similar structures/surfaces.

Figure 2:
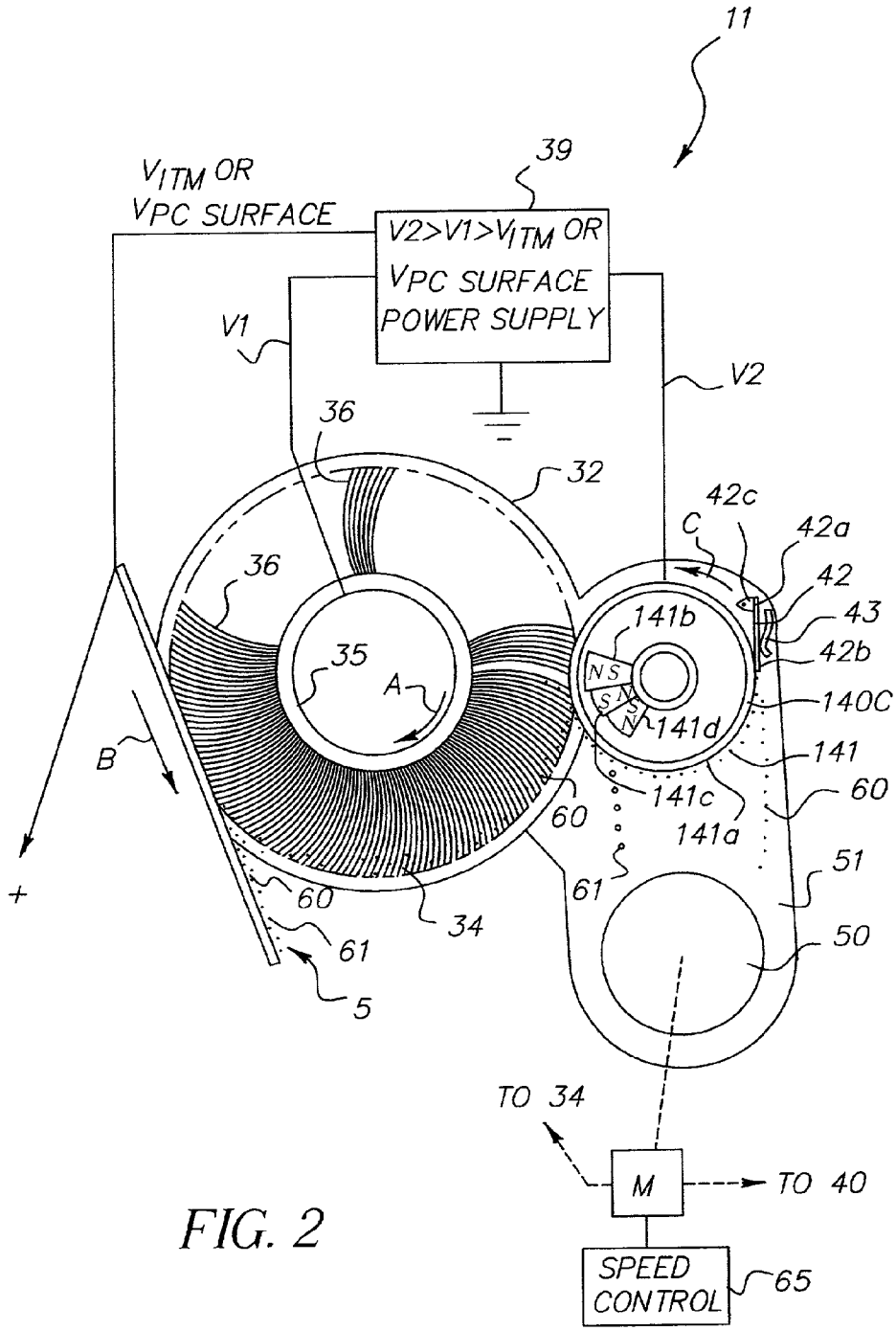
FIG. 2 is a side elevation schematic showing in greater detail the cleaning apparatus forming a part of the apparatus of FIG. 1B.

After the charged toner is transferred to the intermediate transfer drum 5, there still remains some waste toner particles that need to be removed from the primary image member 1. The invention uses a pre-cleaning erase light emitting diode (LED) lamp 9 in combination with pre-cleaning charging station 10 in order to electrostatically modify the surface potential of the non-image areas of the primary image member 1 and the charge on the waste toner remaining on the primary image member 1, respectively. In addition, a cleaning station 8 is included to physically remove any remaining waste toner particles. The cleaning station 8 is illustrated in FIG. 2 and is discussed in greater detail below.

A transfer nip is used between a transfer backer roller 7 and the intermediate transfer drum 5 to transfer the toner image to the receiving sheet 25. In a similar manner to that discussed above, the remaining waste toner particles that remain on the intermediate transferred drum 5 after the toner has been transferred to the sheet 25 are removed using a pre-cleaning charging station 12 and a cleaning station 11. Once again, the details of the cleaning station 11 are shown in FIG. 2 and are discussed below in detail. The receiving sheet 25 is transported by a dielectric conveyor 6 to a fuser 30 where the toner image is fixed by conventional means. The receiving sheet is then conveyed from the fuser 30 to an output tray 35.

The toner image is transferred from the primary image member 1 to the intermediate transfer drum 5 in response to an electric field applied between the core of transfer drum 5 and a conductive electrode forming a part of primary image member 1. The toner image is transferred to the receiving sheet 25 at the nip in response to an electric field created between the backing roller 7 and the transfer drum 5. Thus, transfer drum 5 helps establish both electric fields. As is known in the art, a polyurethane roller containing an appropriate amount of antistatic material to make it of at least intermediate electrical conductivity can be used for establishing both fields. Typically, the polyurethane or other elastomer is a relatively thick layer; e.g., one-quarter inch thick, which has been formed on an aluminum base.

Preferably, the electrode buried in the primary image member 1 is grounded for convenience in cooperating with the other stations in forming the electrostatic and toner images. If the toner is a positively-charged toner, an electrical bias $V_{ITM}$ applied to intermediate transfer drum 5 of typically −300 to −1,500 volts will effect substantial transfer of toner images to transfer drum 2. To then transfer the toner image onto a receiving sheet 25, a bias, e.g., of −2,000 volts or greater negative voltages, is applied to backing roller 7 to again urge the positively-charged toner to transfer to the receiving sheet. Schemes are also known in the art for changing the bias on transfer drum 5 between the two transfer locations so that roller 7 need not be at such a high potential.

The ITM or transfer drum 5 has a polyurethane base layer upon which a thin skin is coated or otherwise formed having the desired release characteristics. The polyurethane base layer preferably is supported upon an aluminum core. The thin skin may be a thermoplastic and should be relatively hard, preferably having a Young's modulus in excess of $5*10^7$ Newtons per square meter to facilitate release of the toner to ordinary paper or another type of receiving sheet. The base layer is preferably compliant and has a Young's modulus of $10^7$ Newtons per square meter or less to assure good compliance for each transfer.

Figure 1B:
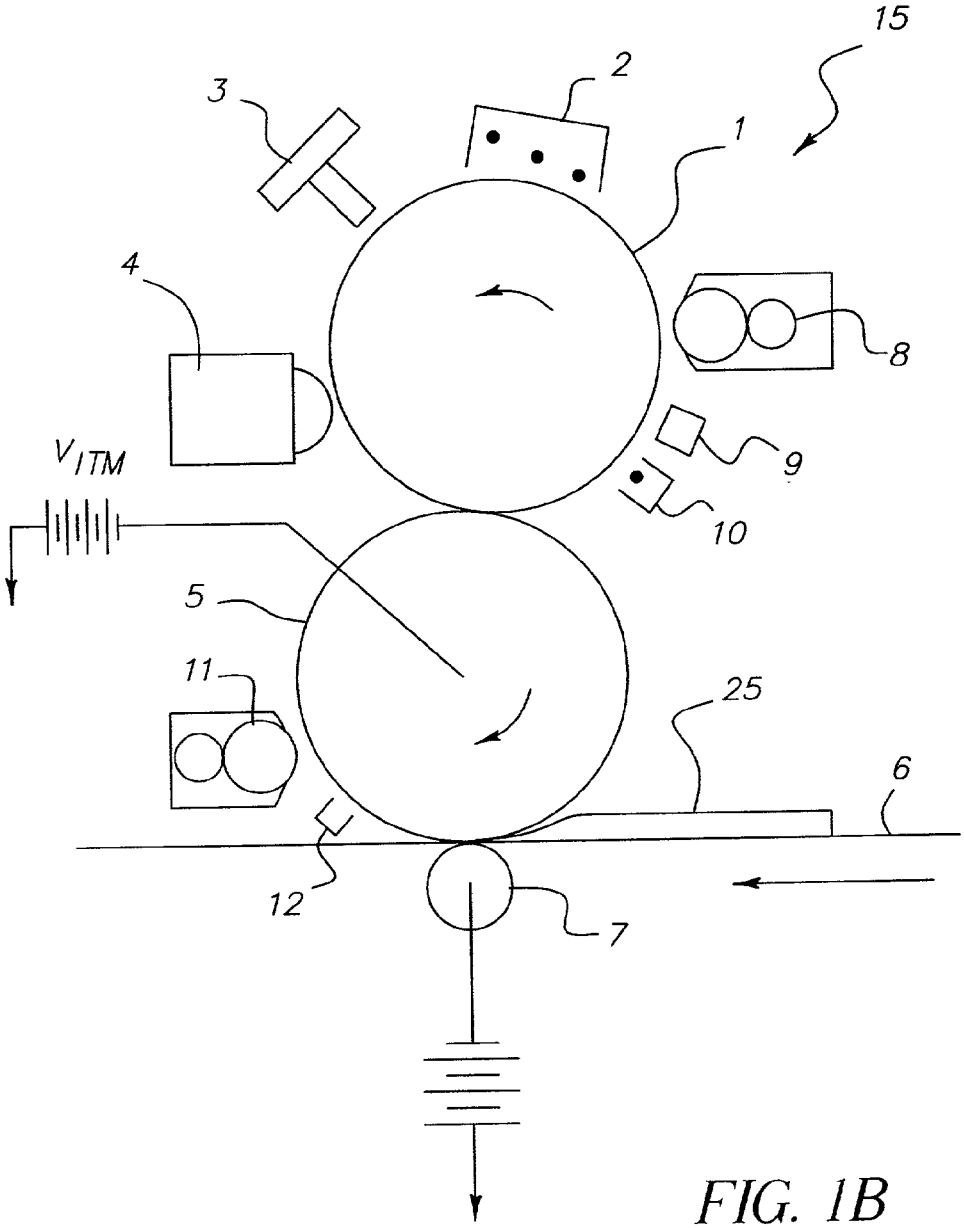

With reference to FIG. 2, the cleaning apparatus 11 in FIG. 1B are shown in greater detail. For illustrative purposes only, cleaning apparatus 11 is shown in detail; however, cleaning apparatus 8 is substantially similar. The cleaning apparatus 11 has a housing 32 which encloses the cleaning brush 34. The brush 34 has conductive fibers 36 which, through an opening in the housing 32, engage the transfer drum 5. The optional cleaning-assist charger 12 may be provided upstream of the area where the cleaning brush contacts the ITM or photoconductor drum to charge the remnant toner 60, 61.

The brush 34 is supported on a core 35 which is driven in rotation by a motor M or other motive source to rotate in the direction of the arrow A as the transfer drum 5 is moved in the direction shown by arrow B. As the brush rotates, untransferred toner particles 60 and other particulate debris, such as carrier particles and paper dust on the transfer drum 5, are mechanically scrubbed from the transfer drum 5 and picked up into the fibers 36 of the brush.

The items illustrated in the figures are generally not shown to scale to facilitate understanding of the structure and operation of the apparatus. In particular, the brush fibers are shown much larger to scale than other structures shown in FIG. 2.

In addition to mechanical scrubbing, an electrical bias is applied to the cleaning brush from power supply 39. The electrical bias V1 of the power supply 39 to the cleaning brush is, as will be more fully explained below, inductively, and not conductively, coupled to the conductive fibers or brush fibers 36. The voltage V1 is greater than the voltage bias $V_{ITM}$ applied to the surface voltage of the drum 5 $V_{PC\ Surface}$. The polarity of the voltage on the brush fibers is such as to electrostatically attract toner 60 to the brush fibers.

The toner particles 60 entrained within the fibers are carried to a rotating detoning roller 140*c* which is electrically biased by power supply 39 to a higher voltage level V2 than the voltage level V1; i.e., the voltage level V2 is of a level to electrostatically attract the toner particles in the brush to the detoning roller. Assuming a positively-charged toner image, as an example, the toner image may be attracted to the transfer drum 5 which is biased to the voltage bias $V_{ITM}$ in the range of about −300 volts to about −1500 volts. The cleaning brush, in such an example would be biased to a potential V1 which is in the range of about −550 volts to about −1750 volts. The detoning roller in this example would be biased to a potential V2 which is in the range of about −800 volts to about −2000 volts. In considering relationships of voltage $V2>V1>V_{ITM}$, the absolute values of the voltages are implied.

The toner particles 60 are electrostatically attracted to the surface 141 of the detoning roller 140*c*. The surface of detoning roller 140*c* is rotated in the direction of arrow C by a drive from motor M counter to that of the brush fibers or alternatively in the same direction. The toner particles are carried by the surface 141 of the detoning roller toward a stationary skive blade 42 which is supported as a cantilever at end 42*a* so that the scraping end 42*b* of the blade 42 engages the surface 141 of the detoning roller.

Toner particles scrubbed from the surface are allowed to fall into a collection chamber 51 of housing 32 and periodically a drive such as from motor M or another motive source, is provided to cause an auger 50, or another toner transport device, to feed the toner to a waste receptacle. Alternatively, the collection receptacle may be provided attached to housing 32, so that particles fall into the receptacle directly and the auger may be eliminated.

The skive blade is made of a metal such as phosphor bronze and is of a thickness of less than 0.5 mm and is engaged by spring force by deflecting the skive blade 42 with respect to the detoning roller surface 141. The skive blade extends for the full working width of the detoning roller surface 141. Sleeve 141*a* is formed of polished aluminum or stainless steel. The sleeve is driven in rotation in the direction of arrow C and is electrically connected to potential V2. A speed controller 65 is schematically shown in FIG. 2. The speed controller will affect the operation of a motor turning the brush 34 by increasing or decreasing the operating speed of the motor to change the operating speed of the brush 34. The structure and operation of speed control devices are well known to those ordinarily skilled in the art and the details of such a device are not discussed herein. For example, a common speed control device is a variable resistor which controls the applied voltage to the motor. However, the invention is not limited to a variable resistor, but instead is applicable to all speed control devices.

As shown above, in a conductive fiber brush cleaning system, electrostatic forces are used to entrain the waste toner in a fiber matrix of the conductive fiber brush 34 after the waste toner is released from the substrate 5 by mechanical action of the brush fiber against the waste toner particle. As is also shown above, this system also employs a biased, magnetic core detone roller 141 to electrostatically attract (scavenge) the waste toner from the conductive fiber brush and collect it in a secondary container.

However, as discussed above, a problem occurs when waste toner that is entrained in the conductive fiber brush 34 escapes from the fiber brush before the electrostatic forces at the detone roller 141 can scavenge the waste toner from the conductive liner brush 34. The toner that escapes from the brush can deposit on surfaces outside the cleaner, causing external contamination that effectively reduces the overall reliability of the cleaning subsystem.

The inventors determined that one cause of such problems stem from insufficient speed control of the conductive fiber brush 34, which causes excessive centripetal force on the waste toner particles 60 and that conventional systems do not provide speed control directed to preventing such excessive centripetal forces. The invention solves the problem described above by controlling the surface velocity of the conductive fiber brush between about 0.130 m/s and 0.270 m/s (about 49 rpm and 102 rpm with 50.8 mm nominal diameter fiber brush). Experimental analysis of the relationship between the external contamination and the cleaning station adjustment parameters show a distinct relationship between the surface velocity of the conductive fiber brush (brush rpm at constant diameter) and the amount of external contamination. External contamination is defined as the sum of upstream (Pre-Cleaner), downstream (Post-Cleaner), and substrate particle counts (particles/$cm^2$ measured from tape transfers from the above mentioned surfaces) after the completion of a standard cleaning protocol. The counts consist of 250 images of a predefined test target (50% area coverage of Dmax stripes in an intrack orientation).

Figure 3:
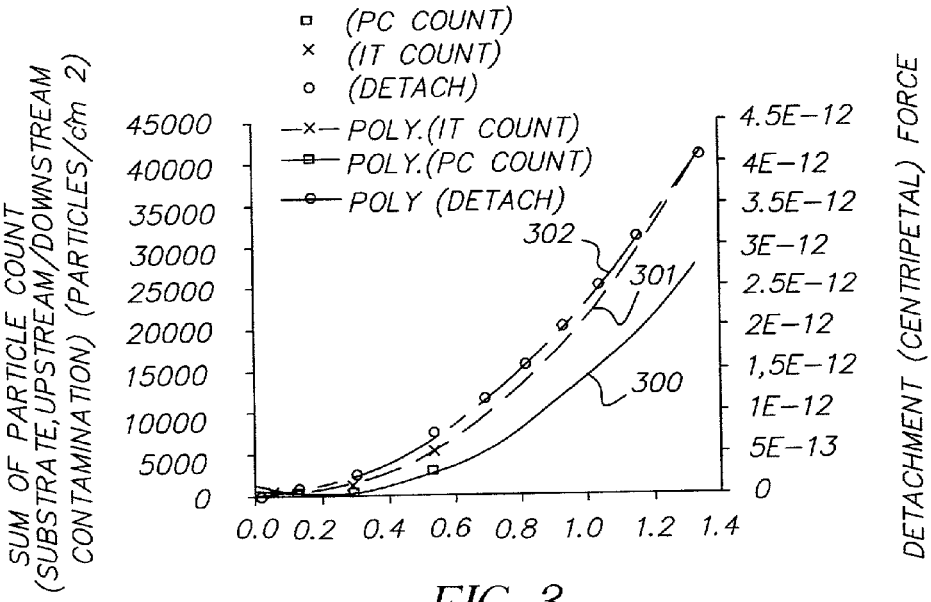
FIG. 3 is a chart showing a comparison of particle detachment force versus brush surface speed.

As shown in FIG. 3, this relationship was observed for the cleaning of two different substrates, the photoconductive primary image member 1 and the intermediate transfer drum 5. The data were then plotted against the calculated detachment force due to the centripetal acceleration ($v^2/r$) from the rotation of the brush (as expressed in meters/second on the horizontal axis). This was based on an average toner diameter of 5 um and a polymer density of 1.05 gm/cm3.

These data are detailed in FIG. 3 wherein the curve 300 represents the sum of the residual toner remaining on the transfer drum 5 and the Photoconductor Drum Cleaning Station upstream and downstream cover surfaces 32. Curve 301 represents the sum of the residual toner remaining on the intermediate transfer drum 5 and the Intermediate Transfer Drum Cleaning Station upstream and downstream cover surfaces 32. Curve 302 represents the detachment force experienced by the waste toner particles 60 within the spinning brush 34. The nature of the external contamination follows the general form of the detachment force curve with some proportionality constant (Contamination $\sim\propto kv^2/r$).

Figure 4:
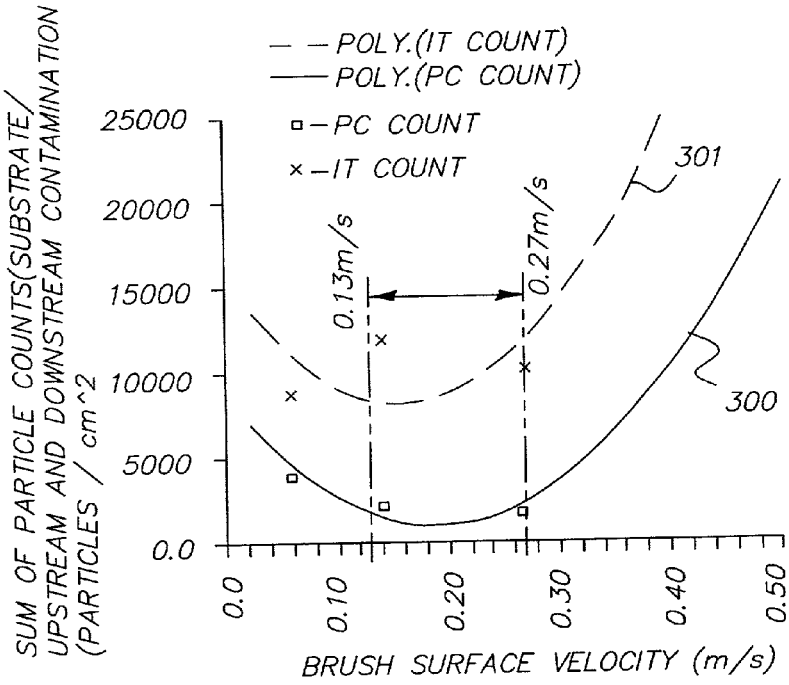
FIG. 4 is a chart showing a comparison of particle detachment force versus brush surface speed.

An expansion of a portion of the graph shown in FIG. 3 is shown in FIG. 4 (notice the change in scale of the brush surface velocity). FIG. 4 more clearly shows the inflection area of the contamination vs. surface speed curves. These curves show that the inflection occurs between 0.150 and 0.200 m/s for both photoconductor 300 and intermediate transfer cleaning 301. At speeds above the inflection points, the detachment force dominates and leads to the increase in contamination. At speeds below the inflection points, there is insufficient time and energy for the brush 34 to remove the waste toner 60 from the substrate of intermediate transfer drum 5. Therefore, the inventors reasoned that the range of speeds at which the cleaning and contamination performance are maximized are between 0.130 and 0.270 m/s.

Due to the nature of the electrophotographic process configuration of the imaging module, post-nip ionization occurring in the photoconductor-intermediate transfer post-nip region can modify the q/m ratios (e.g., charge to mass ratio) of the toner on both surfaces. This post-nip ionization effect generally goes in the direction of increasing the q/m ratio of the toner transferred to the intermediate transfer drum and lowering the q/m ratio of the residual toner on the photoconductor drum. The toner transferred to the intermediate transfer drum then goes through a second transfer nip, where the toner is transferred to the image receiver. The untransferred toner from the secondary transfer nip is also subject to q/m ratio change from the post-nip ionization effect. The q/m changes in the waste toner on the photoconductor and intermediate transfer surfaces can also contribute to the differences in contamination levels measured on the photoconductor and intermediate transfer drum surfaces (proportionality constant k of generalized model). This can be explained in that the actual detachment of a particular toner particle can occur only when the detachment force exceeds the adhesion force between the individual toner particle and the brush fiber, which is a function of the total charge of the individual toner particle. The detachment force of any particular toner particle is a function of the tangential velocity of the particle, which is a function of the distance from the center of rotation and the angular velocity of the brush. Since the diameter of the cleaning brush is constant, this indicates that control of the angular velocity of the brush (brush speed) will control the magnitude of the detachment force.

Therefore, as shown above, the inventors have identified what is causing particles to be lost from the brush and have solved this problem by locating an intermediate speed at which the tips of a cleaning brush should travel in order to be fast enough to allow the brush to effectively remove particles from the substrate being cleaned, yet not so fast as to cause the particles to be thrown from the brush because of excessive centripetal forces. An important feature of the invention is that the invention does not simply arbitrarily slow the brush to prevent particles from being expelled therefrom. To the contrary, the invention defines an optimal speed at which the maximum number of particles are picked up by the brush and maintained by the brush (until they are transferred to the detone roller).

While the invention has been described in terms of preferred embodiments, those skilled in the art will recognize that the invention can be practiced with modification within the spirit and scope of the appended claims.

Parts List

| Item | Description |
|---|---|
| 1 | Primary image member |
| 2 | drum |
| 3 | printhead |
| 4 | development station |
| 5 | transfer roller/drum |
| 6 | conveyor |
| 7 | transfer backer roller |
| 8 | cleaning station |
| 9 | LED lamp |
| 10 | pre-cleaning charging station |
| 11 | cleaning station |
| 12 | pre-cleaning charging station |
| 15 | imaging station |
| 25 | receiving sheet |
| 30 | fuser |
| 32 | casing/housing |
| 34 | cleaning brush |
| 35 | output tray |
| 36 | fibers |
| 39 | power supply |
| 42 | skive blade |
| 42a | cantilever |
| 42b | scraping end |
| 50 | auger |
| 51 | collection chamber |
| 60 | toner particles |
| 65 | speed controller |
| 140c | detoning roller |
| 141 | detoning roller surface |
| 141a | sleeve |
| 300 | photoconductor |
| 301 | intermediate transfer cleaning |

What is claimed is:

1. An image processing apparatus comprising:

an image bearing surface adapted to receive electrostatically charged toner;

a cleaning brush adapted to remove waste particles from said image bearing surface;

a detone roller adapted to remove said waste particles from said cleaning brush; and a speed controller adapted to maintain a rotational speed of said cleaning brush above a minimum speed below which said waste particles would not be removed from said image bearing surface and below a maximum speed above which said waste particles would be thrown from said cleaning brush.

2. The image processing apparatus of claim 1, wherein said image bearing surface comprises a charged photoconductive drum.

3. The image processing apparatus of claim 1, wherein said image bearing surface comprises an intermediate transfer member held at a predetermined potential.

4. The image processing apparatus of claim 1, further comprising an intermediate transfer member adapted to receive said electrostatically charged toner from said image bearing surface by contacting said image bearing surface.

5. The image processing apparatus in claim 4, wherein said image bearing surface comprises a charged drum.

6. The image processing apparatus in claim 4, wherein said intermediate transfer member comprises a charged drum.

7. The image processing apparatus in claim 4, wherein said intermediate transfer member includes a second detone roller, a second cleaning brush and a second speed controller.

8. An image processing apparatus comprising:

a charged photoconductive drum adapted to receive electrostatically charged toner;

a cleaning brush adapted to remove waste particles from said charged photoconductive drum;

a detone roller adapted to remove said waste particles from said cleaning brush; and a speed controller adapted to maintain a rotational speed of said cleaning brush above a minimum speed below which said waste particles would not be removed from said charged photoconductive drum and below a maximum speed above which said waste particles would be thrown from said cleaning brush.

9. The image processing apparatus of claim 8, wherein said charged photoconductive drum comprises a transfer member held at a predetermined potential.

10. The image processing apparatus of claim 8, further comprising an intermediate transfer member adapted to receive said electrostatically charged toner from said charged photoconductive drum by contacting said charged photoconductive drum.

11. The image processing apparatus in claim 10, wherein said intermediate transfer member comprises a second charged drum.

12. The image processing apparatus in claim 10, wherein said intermediate transfer member includes a second detone roller, a second cleaning brush and a second speed controller.

13. A method of reducing airborne waste particles in a cleaner assembly used to clean an image processing apparatus, said method comprising:

providing a speed controller adapted to maintain a rotational speed of a cleaning brush within said cleaner assembly; and controlling said rotational speed to be above a minimum speed below which said waste particles would not be removed from an image bearing surface and below a maximum speed above which said waste particles would be thrown from said cleaning brush.

14. The method in claim 13, further comprising:

providing said image bearing surface, wherein said image bearing surface is adapted to receive electrostatically charged toner;

providing said cleaning brush, wherein said cleaning brush is adapted to remove waste particles from said image bearing surface; and providing a detone roller adapted to remove said waste particles from said cleaning brush.

15. The method of claim 14, wherein said image bearing surface comprises a charged photoconductive drum.

16. The method of claim 14, wherein said image bearing surface comprises an intermediate transfer member held at a predetermined potential.

17. The method of claim 14, further comprising providing an intermediate transfer member adapted to receive said electrostatically charged toner from said image bearing surface by contacting said image bearing surface.

18. The method in claim 17, wherein said image bearing surface comprises a charged drum.

19. The method in claim 17, wherein said intermediate transfer member comprises a charged drum.

20. The method in claim 17, wherein said intermediate transfer member includes a second detone roller, a second cleaning brush and a second speed controller.

21. A method of reducing airborne waste particles in a cleaner assembly used to clean an image processing apparatus, said method comprising:

providing an image bearing surface adapted to receive electrostatically charged toner;

providing a cleaning brush adapted to remove waste particles from said image bearing surface;

providing a detone roller adapted to remove said waste particles from said cleaning brush;

providing a speed controller adapted to maintain a rotational speed of said cleaning brush; and controlling said rotational speed to be above a minimum speed below which said waste particles would not be removed from said image bearing surface and below a maximum speed above which said waste particles would be thrown from said cleaning brush.

22. The method of claim 21, wherein said image bearing surface comprises a charged photoconductive drum.

23. The method of claim 21, wherein said image bearing surface comprises an intermediate transfer member held at a predetermined potential.

24. The method of claim 21, further comprising providing an intermediate transfer member adapted to receive said electrostatically charged toner from said image bearing surface by contacting said image bearing surface.

25. The method in claim 24, wherein said image bearing surface comprises a charged drum.

26. The method in claim 24, wherein said intermediate transfer member comprises a charged drum.

27. The method in claim 24, wherein said intermediate transfer member includes a second detone roller, a second cleaning brush and a second speed controller.

* * * * *